United States Patent [19]

Dickerson

[11] Patent Number: 4,526,229

[45] Date of Patent: Jul. 2, 1985

[54] HYDRAULIC PACKER ASSEMBLY

[75] Inventor: Richard C. Dickerson, Slidell, La.

[73] Assignee: Gulf Oil Corporation, Pittsburgh, Pa.

[21] Appl. No.: 465,836

[22] Filed: Feb. 14, 1983

[51] Int. Cl.[3] ..... E21B 23/04; E21B 33/129

[52] U.S. Cl. ..... 166/120; 166/125; 166/182; 166/237

[58] Field of Search ..... 166/120, 125, 123, 181, 166/182, 237

[56] References Cited

U.S. PATENT DOCUMENTS

| | | | |
|---|---|---|---|
| Re. 25,846 | 8/1965 | Campbell | 166/122 |
| Re. 26,379 | 4/1968 | Cochran et al. | 166/120 |
| 2,189,697 | 2/1940 | Baker | 166/121 |
| 2,189,701 | 2/1940 | Burt et al. | 166/122 |
| 2,270,648 | 1/1942 | Church | 166/120 |
| 2,290,142 | 7/1942 | Burt | 166/122 |
| 2,373,005 | 4/1945 | Baker | 166/120 |
| 2,695,064 | 11/1954 | Ragan et al. | 166/120 |
| 2,711,795 | 6/1955 | Ragan | 166/120 |
| 2,764,243 | 9/1956 | Page | 166/122 |
| 2,854,080 | 9/1958 | Dale et al. | 166/120 |
| 2,878,877 | 3/1959 | Baker | 166/120 |
| 3,002,561 | 10/1961 | Baker et al. | 166/120 |
| 3,011,557 | 12/1961 | Conrad | 166/120 |
| 3,032,113 | 5/1962 | Dollison | 166/125 |
| 3,050,128 | 8/1962 | Brown | 166/120 |
| 3,054,450 | 9/1962 | Baker | 166/120 |
| 3,062,291 | 11/1962 | Brown | 166/120 |
| 3,109,490 | 11/1963 | Baker | 166/123 |
| 3,112,796 | 12/1963 | Myers | 166/120 |
| 3,181,614 | 5/1965 | Brown | 166/122 |
| 3,211,226 | 10/1965 | Myers et al. | 166/120 |
| 3,211,227 | 10/1965 | Mott | 166/120 |
| 3,215,204 | 11/1965 | Sims | 285/315 |
| 3,299,955 | 1/1967 | Page, Jr. | 166/120 |
| 3,339,637 | 9/1967 | Holden | 166/120 |
| 3,438,438 | 4/1969 | Conrad | 166/121 |
| 3,455,381 | 7/1969 | Page, Jr. | 166/121 |
| 3,548,936 | 12/1970 | Kilgore et al. | 166/121 |
| 3,559,732 | 2/1971 | Tucker | 166/120 |
| 4,049,055 | 9/1977 | Brown | 166/120 |
| 4,190,107 | 2/1980 | Oden et al. | 166/125 |
| 4,237,979 | 12/1980 | Weise | 166/120 |
| 4,345,649 | 8/1982 | Baugh et al. | 166/120 |
| 4,441,559 | 4/1984 | Evans et al. | 166/120 |

*Primary Examiner*—Stephen J. Novosad
*Assistant Examiner*—Hoang C. Dang
*Attorney, Agent, or Firm*—Deane E. Keith; Forrest D. Stine

[57] ABSTRACT

An hydraulic packer assembly for sealing an annulus between a well casing and a tubing string inserted within the well casing comprises a packer (10) and a setting tool (12). The packer includes a packer body (22) having an internal bore (23) with a seal (18) and gripping members (20) mounted on its exterior surface for engaging the interior surface of the well casing. Actuating mechanisms are provided within the packer for expanding the seal and gripping members into contact with the casing wall, which mechanisms include a piston and cylinder arrangement operated by fluid pressure conveyed from the tool interior to the cylinder. The setting tool is releasably coupled to the packer body to mount it on a tubing string and for conveying fluid pressure to the actuating mechanisms. Seals on the setting tool provide a fluid tight seal between the setting tool and the axial bore through the packer body.

18 Claims, 5 Drawing Figures

HYDRAULIC PACKER ASSEMBLY

BACKGROUND OF THE INVENTION

I. Field of the Invention

This invention relates to a hydraulic packer assembly which is set in a casing of an oil or gas well. More particularly, the present invention relates to a hydraulic packer assembly comprising a packer and a setting tool, which packer is secured and sealed to the casing by a fluid pressure passing through a tubing string and into the setting tool.

II. Description of the Prior Art

In an oil or gas well, the annular space or annulus between the tubing string and the well casing is sealed by a packer. The packer causes the fluid being pumped, e.g., oil, from the earth cavity penetrated by the casing to flow within the tubing string and not between the tubing string and the well casing. Conventionally, the packer is mounted on a setting tool, which setting tool is coupled to the end of a tubing string, or on an electric cable that is lowered into the well casing. Once the packer is located at the appropriate depth within the well casing, suitable mechanisms are actuated securing and sealing the packer to the inner surface of the well casing, thereby sealing the annular space between the tubing string and well casing.

One conventional system for setting and sealing the packer within the well casing is electrically operated. Such system requires rigging and feeding an electrical line and packer assembly through the well casing from the surface. However, the electrical lines are expensive and are difficult and time consuming to feed through the casing. Additionally, packers set with electrical lines create additional risk and expense by requiring swabbing or jetting of the well with nitrogen when bringing the oil or gas well on production. Expensive rig time is also used while landing the tubing string in the packer, and when swabbing or jetting the well with nitrogen.

Conventional mechanical and hydraulic packers also experience difficulties. Such packers have not permitted relative movement between the tubing and the packer causing large amounts of stress on both the tubing string and the packer. Additionally, such packers have failed when the formation is stimulated or the tubing string is subjected to high fluid pressure. Moreover, the mechanical packers require weight to be set on the packer which can deform the tubing string and hinder the passage of wireline tools. Typical examples of conventional hydraulic packers are disclosed in U.S. Pat. No. 3,112,796 to Myers and U.S. Pat. No. 3,211,227 to Mott, the disclosures of which are hereby incorporated by reference.

Each of the conventional packer systems has its own advantages and disadvantages. Thus, a packer is needed which will combine the advantages normally associated with mechanically, electrically and hydraulically operated systems, without their normally attendant disadvantages.

SUMMARY OF THE INVENTION

It has now been discovered that many of the advantages normally associated with conventional hydraulic, electrical and mechanical packer systems can be combined in a single packer system without most of the usual disadvantage of such conventional packer systems, by the present invention which comprises an hydraulic packer assembly wherein the setting tool is releasably coupled to the packer body. In this manner, the setting tool and the tubing string attached thereto may move relative to the packer to facilitate well operation and to relieve stresses on the packer.

In the assembly of the present invention, the packer body has an internal axial bore extending through it, a first seal for forming a fluid tight seal between the body and the well casing and a gripping mechanism for securing the body to the well casing. A piston and cylinder arrangement is provided to operate in response to fluid pressure for expanding the sealing and gripping mechanisms into contact with the well casing. The setting tool releasably couples the body to a tubing string and conveys fluid pessure in the tubing string to the mechanism for actuating the packer body seal and gripping mechanisms. Additionally, the setting tool can have exterior seal means for providing a fluid tight seal between the setting tool and the packer body bore.

The setting tool can comprise a tubular mandrel having a radially extending port arrangement. Upon locating a plugging device in the mandrel below the setting tool port, fluid pressure in the tubing string and setting tool can pass through such port arrangement to actuate the piston and cylinder arrangement of the packer sealing and gripping mechanisms.

The mechanism for releasably coupling the setting tool to the packer body can comprise a catch in an upper portion of the packer body which extends inwardly from its internal surface and a releasable latch on the setting tool. In a locking position, the latch engages the packer catch, while in a release position the latch is disengaged from the catch. The latch can comprise a plurality of members biased toward the release position and a reciprocating sleeve for maintaining the members in their locking position. The sleeve is actuated by a piston and cylinder arrangement in fluid communication with the exterior of the setting tool through a port. Such port permits fluid pressure to be conveyed from the annulus between the setting tool and the well casing above the packer seal for releasing the latch mechanism.

The setting tool can comprise inner and outer sleeves coupled such that the sleeves can move to a limited extent axially relative to each other. The sleeves have aligned ports to permit fluid pressure to be conveyed from the tubing string, through the tool, and into the packer gripping and seal actuating mechanisms. The outer sleeve has axially spaced seals on its inner surface located above its port. When the inner and outer sleeves are shifted axially, the inner sleeve port is located between and closed by the axially spaced seals preventing the flow of fluid pressure between the tool interior and the packer actuating mechanisms.

The mechanism controlling the limited movement of the inner and outer sleeves can include a radially inwardly projecting shoulder on the packer body and a radially outwardly projecting detent on the outer sleeve. In their initial positions, the detent is spaced below the shoulder, but contacts the shoulder when the packer body is released from the setting tool and the setting tool and tubing string are raised. The engagement of the shoulder and detent limit upward movement of the outer sleeve such that continued upward force will shear a screw coupling the inner and outer sleeves permitting the inner sleeve to continue its movement upwardly.

The inner and outer sleeves are oriented relative to each other to close the inner sleeve port with the axially spaced seals on the outer sleeve by an inwardly extending annular recess on the exterior of the inner sleeve. Such recess is initially located below the detent when the sleeves are coupled by the shear screw. As the inner sleeve is raised relative to the outer sleeve, the detent will be received within the recess to again couple the sleeves for simultaneous movement and to locate the sleeves for closing of the inner sleeve port. Such arrangement enables the setting tool and tubing string to move freely within the packer body. Additionally, the pressure supplied within the tubing string and setting tool will not adversely affect the packer seal and gripping mechanisms since the interior of the setting tool is no longer in fluid communication with the mechanisms for actuating the packer seal and grippers.

Other advantages, and salient features of the present invention will become apparent from the following detailed description, which taken in conjunction with the annexed drawings, discloses a preferred embodiment of the present invention.

DETAILED DESCRIPTION OF THE PREFERRED EMBODIMENT OF THE INVENTION

Figure 1A:
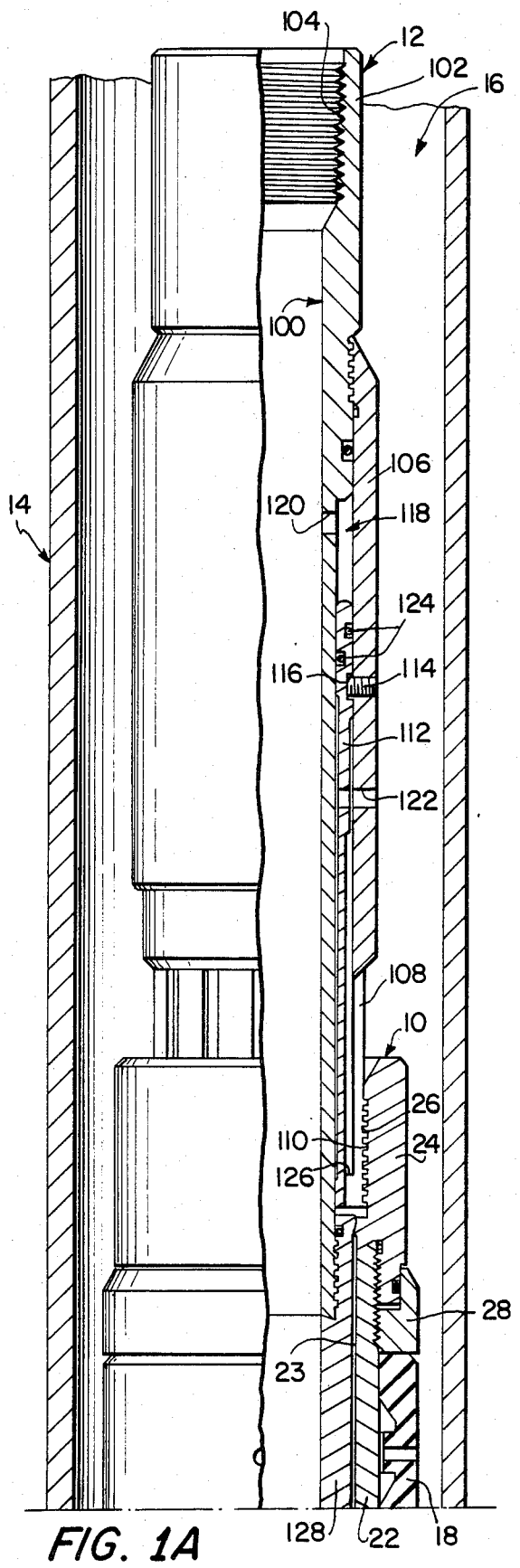
FIG. 1A and 1B are side elevational views, in partial section, of an hydraulic packer assembly in accordance with the present invention, illustrating the assembly as it is being lowered into a well casing with FIG. 1B being a lower continuation of FIG. 1A.
Figure 1B:
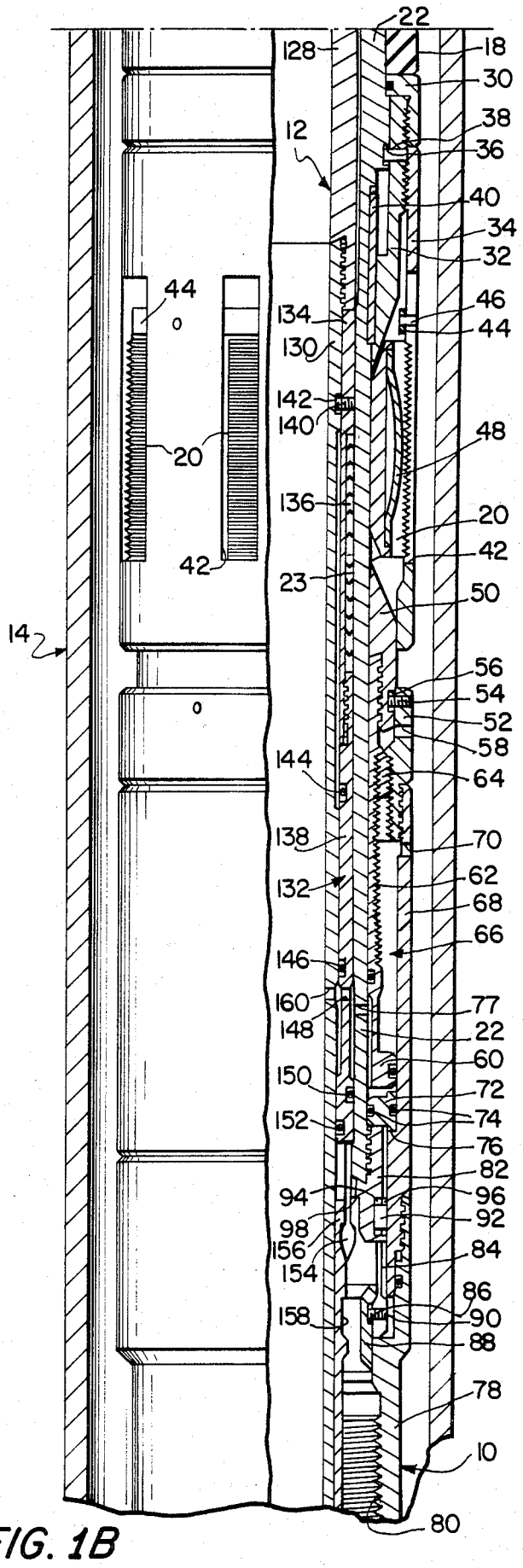

Referring initially to FIGS. 1A and 1B, the hydraulic packer assembly of the present invention comprises a packer 10 and a setting tool 12. Packer 10 is releasably mounted on the exterior of setting tool 12 for setting it within a casing 14 of an oil or gas well, which casing is typically cemented in the well bore. Basically, the setting tool with the packer releasably mounted thereon is lowered into the casing on the end of a tubing string. Once the packer is located at the desired depth within the casing, the packer is fixed and sealed to the casing inner surface to seal the annulus or annular space 16 between the setting tool-tubing string and casing 14. In this manner, the fluid being pumped from the well is prevented from passing upwardly above the packer outside of the tubing string.

Packer 10 comprises a packing element 18 for sealing the annulus and a plurality of slips or gripping members 20 for securing and maintaining the packer in the desired axial position within the casing. Suitable hydraulic mechanisms are provided in packer 10 for causing packing element 18 and gripping members 20 to contact the casing in a well.

Packer 10 has a generally cylindrical packer body 22 supporting packing element 18 and gripping members 20 and having an internal, axial bore 23. At the upper end of the packer body (see FIG. 1A), a top sub 24 is coupled to exterior threads on body 22. Top sub 24 has internal square threads 26 forming a catch for releasably coupling packer 10 to setting tool 12 as will be explained in greater detail hereinafter.

Packing element 18 is formed of resilient, elastomeric material and bounded on its opposite axial ends by upper and lower gage rings 28 and 30, respectively. Upper gage ring 28 is fixed to body 22, while lower gage ring 30 is slidable on the exterior surface of the body. Upward movement of lower gage ring 30 causes packing element 18 to be compressed axially and expanded radially into sealing engagement with well casing 14.

Gripping members 20 and the means for actuating such members are located below packing element 18. Lower gage ring 30 is threadedly engaged with an upper cone member 32 which is in turn threaded to the internal surface of a slip cage 34 such that lower gage ring 30, upper cone member 32 and slip cage 34 move as a single unit. Upper cone member 32 is coupled to packer body 22 by a shear screw 36 received in an external recess 38 in body 22, and is slidably coupled to a key 40 on packer body 22 to prevent the upper cone member from rotating about the packer body, restricting its movement to only the axial direction. Slip cage 34 has openings 42 through which gripping members 20 can extend upon expansion. Located across openings 42 is a detent ring 44 attached to the slip cage by shear pins 46 to prevent upward movement of gripping members 20 until pins 46 are sheared. Gripping members 20 also have a slip spring 48. A slidable lower cone member 50 is located below gripping members 20. The gripping members and upper and lower cone members have mating frustoconical surfaces such that upward movement of the lower cone member will force the gripping members initially upwardly against the upper cone member and against detent ring 44 and then upwardly and outwardly upon severing of shear pins 46.

The lower cone member is releasably attached to a generally cylindrical lock ring housing 52 by a brass shear screw 54. Shear screw 54 is mounted in lock ring housing 52 and is received within a recess 56 in the exterior surface of the lower cone member. The lock ring housing also has an exhaust port 58 extending radially therethrough.

A setting piston 60 is threadedly engaged with and depends from lower cone member 50, and is slidably engaged with the exterior surface of packer body 22. The exterior surface of piston 60 adjacent to but below lower cone member 50 has a plurality of external serrations 62. Serrations 62 are releasably engageable with a lock ring 64 mounted on the internal surface of housing 52. When piston 60 is forced upwardly shear screw 54 is severed releasing lower cone 50 from lock ring housing 52 and permitting upward movement of piston 60 through locking ring 64 in a ratchet like manner to prevent downward movement of setting piston 60.

Setting piston 60 is movable within a cylindrical cavity or cylinder 66 formed by chamber 68. Chamber 68 is fixedly coupled by threads to a lower extension of lock ring housing 52 and has an exhaust port 70 at its upper portion to relieve pressure above setting piston 60 during its upward movement. The lower portion of cylinder 66 is closed in a fluid tight manner by a seal bushing 72 having O-ring seals 74. Seal bushing 72 rests on an inwardly projecting shoulder 76 on chamber 68. A fluid pressure port 77 extends radially through packer body 22 to convey fluid pressure to cylinder 66 below setting piston 60.

A bottom sub 78 having internal threads 80 is secured to the lower end of chamber 68 by a threaded connection. The lower sub permits the packer to have other apparatus coupled to and depend from its lower portion.

A collet 82 is threadedly secured on the lower end of packer body 22 and depends therefrom. The collet has a plurality of legs 84 depending thereform, which legs have brass shear screws 86 mounted in the lower portions thereof and extending radially inwardly. A generally cylindrical collet support 88 is mounted between collet legs 84 and has an external recess 90 receiving shear screws 86 to releasably couple collet support 88 to collet 82.

A lower key 92 is received in axial grooves 94 and 96 in collet 82 and chamber 68 to prevent relative rotation therebetween. On the internal surface of collet 82 a shoulder 98 extends radially inwardly above collet support 88.

Setting tool 12 is mounted within and is coupled to packer body 22. The setting tool comprises a generally cylindrical tubular mandrel 100 having a top sub 102 with internal threads 104 at its upper end for securing the setting tool to the lower end of a tubing string.

A latch mechanism is mounted on the exterior of mandrel 100 immediately below top sub 102 for releasably coupling the tool to packer 10. Such latch mechanism comprises a collet 106 threadedly secured to the exterior of mandrel 100 and having resilient latch members 108 depending therefrom. Latch members 108 are biased radially inwardly and have square threads 110 formed on their exterior surface configured to mate with the internal threads 26 of packer top sub 24.

An annular piston 112 is slidably received in the annular space 118 between mandrel 100 and collet 106 for axial movement to control the radial movement of latch members 108. The latch mechanism piston is initially and releasably maintained in its lower most position by a shear screw 114. Shear screw 114 is mounted in collet 106 and extends radially inwardly such that it is received with an external recess 116 in piston 112. Annular space 118 defined by mandrel 100 and collet 106 is in fluid communication with the interior of the mandrel through an exhaust port 120 located above the piston at the upper end of the annular space 118 and extending radially through the mandrel, and is in fluid communication with the exterior of collet 106 through a setting tool release port 122 extending radially through the collet and below shear screw 114 and the seals 124 in the head of piston 112.

In the initial position of piston 112 with shear screw 114 located in recess 116, the lower end of the piston is located between mandrel 100 and the lower end of the latch members 108 maintaining the latch members radially outward in engagement with the packer top sub 24. When fluid pressure is supplied though port 122 raising piston 112 and severing shear screw 114, the lower end of the piston moves upwardly to a point above the radially inwardly extending shoulders 126 adjacent the lower ends of the latch members. Once the lower end of the piston is located above shoulders 126, latch members 108 move inwardly under the force of their inherent bias into a release position disengaged from the threads of packer top sub 24.

Below the latching mechanism, the mandrel includes a locator 128 threadedly secured to top sub 102. The locator 128 is threadedly secured to an inner sleeve 130 (as seen in FIG. 1B) about which an outer sleeve 132 is mounted for limited, axial movement relative to the outer sleeve.

The outer sleeve comprises an upper seal sub 134, a chevron stack 136 and a collet 138. Upper seal sub 134 has a radially inwardly projecting brass shear screw 140 received in a radially extending recess 142 in the exterior of inner sleeve 130 for releasably securing the inner and outer sleeves. Chevron stack 136 is secured between upper seal sub 134 and collet 138 on the exterior surface of outer sleeve 132, and provides a fluid tight seal between the exterior of setting tool 12 and internal bore 23 extending through the packer. Collet 138 is threadedly secured to a lower extension of upper seal sub 134 and has two axially spaced O-ring seals 144 and 146 on its interior surface providing a seal between the inner and outer sleeves. Below seal 146, collet 138 has a fluid pressure port 148 and an exterior seal 150 and an interior seal 152. Exterior seal 150 contacts the interior bore of the packer body, while the interior seal 152 engages inner sleeve 130. Below seals 150 and 152, the collet has a depending detent 154 which is spring biased radially inwardly, but maintained in a radially extended position against its inherent bias by a collet support 156 on the inner sleeve. Collet support 156 has a radially inwardly extending recess 158 for receiving detent 154, but initially located below the detent as will be explained in greater detail hereinafter.

Inner sleeve 130 has a fluid pressure port 160 extending radially therethrough adjacent port 148 in the initial position of the inner and outer sleeves. The lower end of the inner sleeve can be coupled to a lower seal sub supporting a chevron stack on its exterior surface, as well as other mechanisms for coupling other well tools to the lower end of the setting tool, e.g., a landing nipple or ball catcher sub.

In operation, packer 10 and setting tool 12 are initially arranged as illustrated in FIGS. 1A and 1B, i.e., with the packer releasably coupled about the setting tool. Mandrel top sub 102 is coupled to the lower end of a tubing string to lower the tool and packer to the desired depth within well casing 14. In this position, piston 112 is retained in its lower position by shear screw 114 maintaining latch members 108 in engagement with packer to sub 24, thereby coupling the tool and packer. Additionally, in the tool, shear screw 140 maintains inner and outer sleeves 130 and 132 in the position illustrated in FIG. 1B such tha detent 154 is spaced above recess 158 and ports 160 and 148 are aligned so that fluid pressure can pass therethrough. In the packer, packing element 18 and gripping members 20 are retracted to facilitate passage of the packer through the casing. The packer and tool are coaxially arranged such that port 77 is in fluid communication with ports 160 and 148, and shoulder 98 is spaced above detent 154.

Figure 2A:
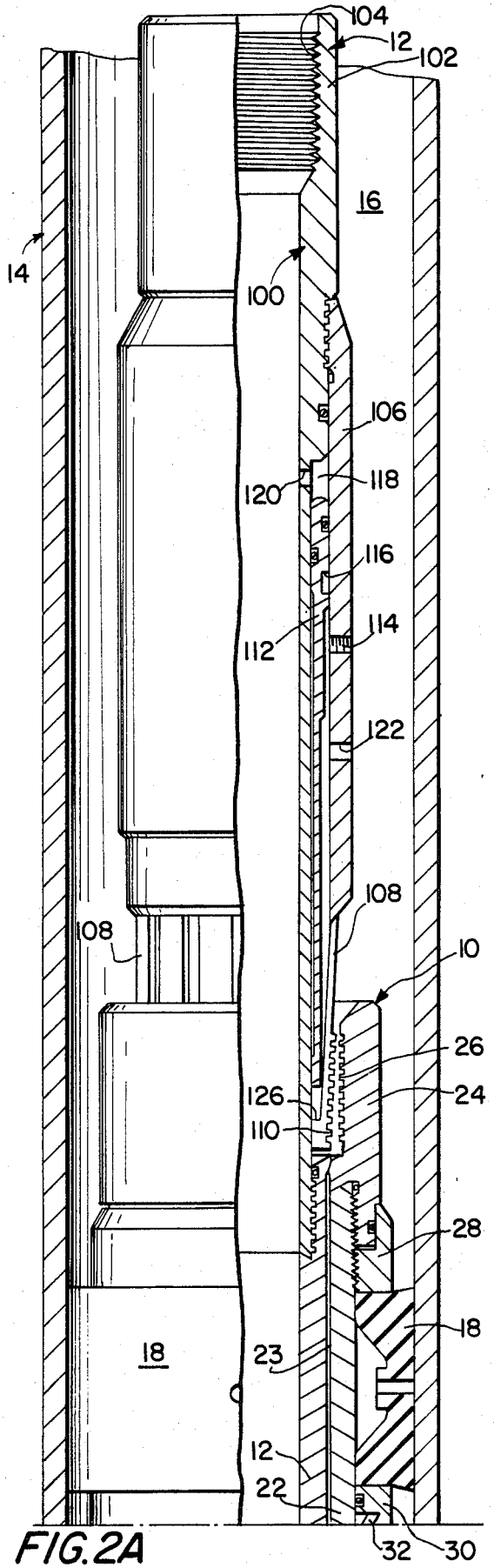
FIGS. 2A and 2B are side elevational views, in partial section, illustrating the assembly of FIGS. 1A and 1B set and sealed to the well casing and with FIG. 2B being a continuation of the lower portion of FIG. 2A.

Once the packer has been located at the appropriate depth within the well casing, a plugging device is lowered into the tubing string closing its lower end. Such plugging device can be lowered on a wire line to permit it to be withdrawn from the tubing after pressurizing the tubing string to set and seal the packer. With the lower end of the tubing string and setting tool closed, the interior of the tubing string and setting tool is pressurized such that fluid pressure passes through ports 160 and 148 in the setting tool and port 77 in the packer to apply fluid pressure in cylinder 66 below setting piston 60. Such fluid pressure causes setting piston 60 to move upwardly within cylinder 66 as serrations 62 move in and out of engagement with lock ring 64 permitting upward movement of the piston and preventing downward movement of the piston. Upward movement of the piston causes a corresponding upward movement of lower cone member 50 severing shear screw 54. Upward movement of the lower cone member forces gripping members upwardly against upper cone member 32 and detent ring 44 transmitting an upward force to lower gage ring 30 and axially compressing packing element 18. When upper cone member 32 is forced upwardly, shear pin 36 is severed releasing the upper cone member for axial movement relative to packer body 22. The packing element 18 is compressed until it engages the interior surface of well casing 14 in a fluid tight manner as illustrated in FIG. 2A.

Figure 2B:
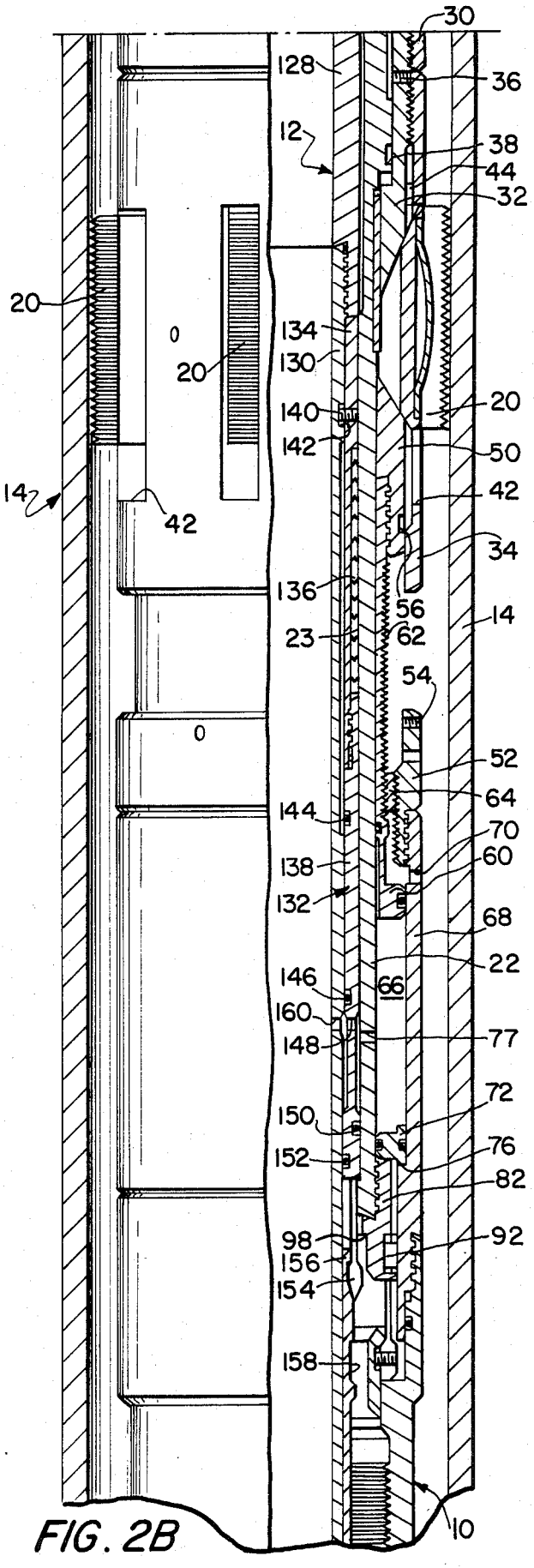

Continued upward pressure provided by piston 60 will sever shear pins 46 releasing detent ring 44 and permitting gripping members 20 to move upwardly on the frustoconical surfaces of upper cone member 32 and lower cone member 50 such that the gripping members move upwardly and outwardly into engagement with the inner surface of the well casing as illustrated in FIG. 2B.

Packer 10 is now set and sealed within well casing 14. Additionally, chevron sealing stacks 136 on the external surface of the tool provide a fluid tight arrangement between the tool and the interior of packer body 122.

After the packer has been set and sealed within the casing, the setting tool can be released therefrom to permit relative movement between the setting tool and the packer. Release of the setting tool is accomplished by pressurizing annulus 16 between well casing 14 and setting tool 12 above packer element 18. This fluid pressure enters port 122 below the head of piston 112 forcing the piston upwardly and severing shear screw 114 to permit upward movement of the piston. Upward movement of the piston continues until the lower end of the piston clears shoulders 126 permitting latch members 108 to spring radially inwardly under the influence of their inherent spring bias to disengage latch member threads 110 from packer top sub threads 26 as illustrated in FIG. 2A. Setting tool 12 is now disengaged from packer 10 and is capable of freely sliding therein with the space between the tool and packer being sealed by chevron stack 136. The well is now ready for operation.

During operation of the well, the well can be treated in such a manner that the temperature of the tubing string is lowered. Since the tubing string is fixed at the well head assembly, cooling of the tubing string causes it to contract and move upwardly within the packer. Additional chevron stacks can be provided along the length of the tool and tubing string to maintain a sealing relationship with internal axial bore 23 of packer body 22.

Figure 3:
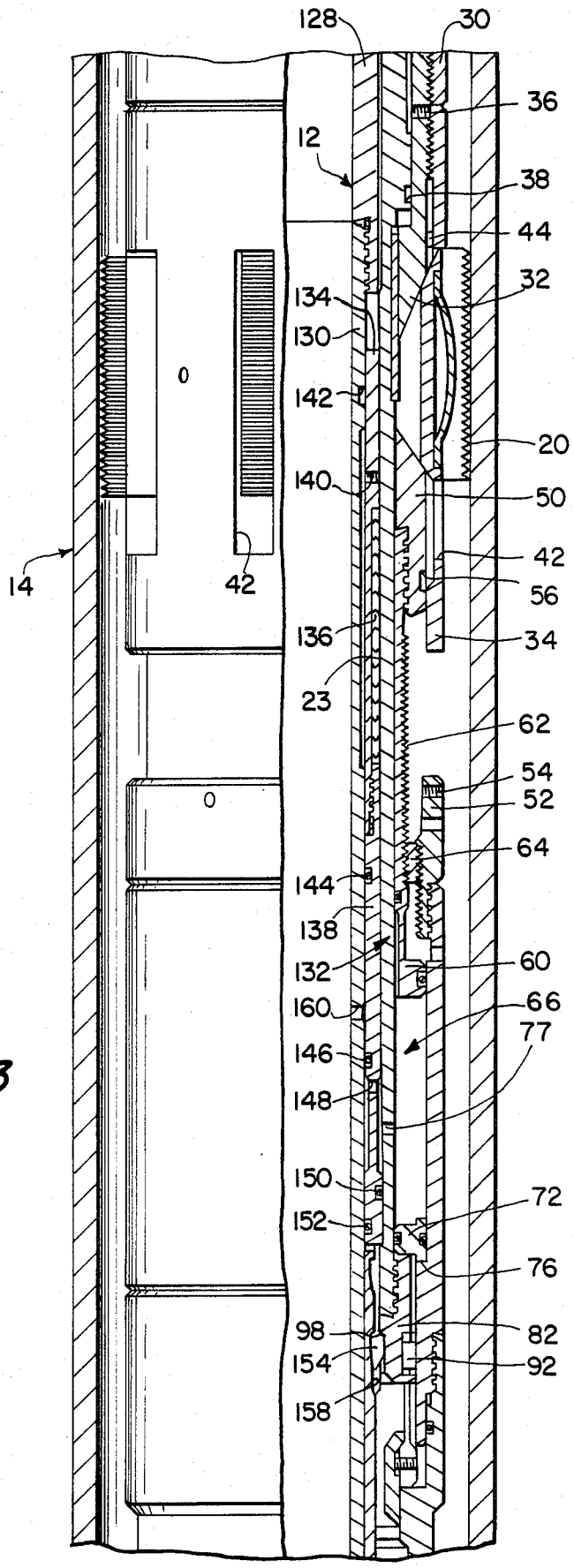
FIG. 3 is a partial side elevational view, in partial section, illustrating the hydraulic packer assembly of FIGS. 1A and 1B with the tool freely slidable within the packer body and the tool ports closed.

As the tubing string moves upwardly, detent 154 of setting tool 12 engages shoulder 98 on the interior of packer 10 as illustrated in FIG. 3. Continued upward movement of the tubing string severs shear screw 140 releasing inner sleeve 130 for relative axial movement relative to outer sleeve 132. Outer sleeve 132 is restrained against axial movement within the packer by the engagement of detent 154 with shoulder 98. Inner sleeve 130 continues moving upwardly relative to outer sleeve 32 until recess 158 is aligned and receives detent 154. Receipt of detent 154 within recess 158 permits the detent to move radially inwardly out of engagement with shoulder 98 to permit the outer sleeve to move axially within the packer again and to couple the inner and outer sleeves for simultaneous axial movement within the packer.

Additionally, this relative movement of inner sleeve 130 and outer sleeve 132 reorients ports 160, 148 and 77 that supply fluid pressure for setting piston 60 such that the setting tool interior is no longer in fluid communication with setting cylinder 66. Specifically, port 160 in inner sleeve 130 is now located between seals 144 and 146 on outer sleeve 132 such that fluid pressure cannot pass therethrough. In this manner, pressure increases within the tubing string will not affect the sealing of packing element 18 or the engagement of gripping members 20 with the well casing. Additionally, such positioning will isolate the tubing string interior from annulus 16.

Packer 10 is retrievable from the well casing by a conventional releasing tool lowered into the packer after setting tool 12 has been removed from the packer and raised to the surface. The releasing tool releases cone members 32 and 50 retracting gripping members 20 to permit removal of the packer from the well casing.

The hydraulic packer assembly of the present invention comprising packer 10 and setting tool 12 provides a highly effective mechanism for sealing the annulus between a tubing string and a well casing. Setting ports 148 and 160 in the tool and port 77 in the packer provide a simple, yet effective mechanism for supplying fluid pressure to the packer in order to actuate its sealing and gripping mechanisms. The limited relative movement provided between inner sleeve 130 and outer sleeve 132 of setting tool 12 permit the fluid communication between setting cylinder 66 and the tubing string interior to be closed such that pressure changes within the tubing string will not affect the packer sealing and gripping mechanisms. Chevron stacks on the exterior of the setting tool and tubing string permit it to move axially within the packer while maintaining a seal with axial bore 23 through packer body 22. Movement between the packer and tubing string is permitted by the releasable coupling of the tool and packer provided by latch members 108.

Although the invention has been described in considerable detail with particular reference to a certain preferred embodiment thereof, variations and modifications can be effected within the spiritt and scope of the invention as defined in the appended claims.

What is claimed is:

1. A hydraulic packer assembly for a well casing, which comprises:

a packer body having an internal axial bore extending therethrough;

first sealing means mounted on said body for forming a fluid tight seal between said body and a well casing;

gripping means mounted on said body for securing said body to the well casing;

actuating means for expanding said sealing means and gripping means into contact with the well casing, including a first piston slidable in response to fluid pressure within a first cylinder and having first port means for conveying fluid pressure to said cylinder;

a catch on an upper portion of said packer body extending from an internal surface thereof;

setting tool means for releasably coupling said body to a tubing string and for conveying fluid pressure in the tubing string to said first port means to operate said actuating means;

releasable latch means on said setting tool movable between a locking position engaging said catch and a release position disengaged from said catch, said latch means including latch members biased toward said release position and a reciprocating sleeve for maintaining said latch members in said locking position, said reciprocating sleeve being actuated by a piston and cylinder means and setting tool release port means in said setting tool for conveying fluid pressure from a space between said setting tool means and the well casing and above said first sealing means to said piston and cylinder means;

a tubular mandrel on said setting tool means with a collet coupled to said tubular mandrel and supporting said latch members, said collet being laterally spaced from said tubular mandrel forming an annular space defining an annular cylinder of said piston and cylinder meeans and slidably receiving an annular piston of said piston and cylinder means, said reciprocating sleeve being coupled to said annular piston for simultaneous movement therewith, said setting tool release port means being a radially extending aperture in said collet; and second seal means on said setting tool means for providing a fluid tight seal between said setting tool means and said body bore.

2. The hydraulic packer assembly of claim 1 wherein said setting tool means comprises a tubular mandrel having a radially extending second port means for providing fluid communication between the interior of said tubular mandrel and said first cylinder.

3. The hydraulic packer assembly of claim 1 wherein said aperture is located below said annular piston.

4. The hydraulic packer assembly of claim 1 wherein said reciprocating sleeve is located laterally between said latch members and said tubular mandrel in said locking position.

5. The hydraulic packer assembly of claim 4 wherein said latch members comprise shoulders extending radially inwardly from free ends thereof, engaging said reciprocating sleeve in said locking position, and being spaced from said reciprocating sleeve in said release position.

6. A hydraulic packer assembly for a well casing, which comprises:

a packer body having an internal axial bore extending therethrough;

first sealing means mounted on said body for forming a fluid tight seal between said body and a well casing;

gripping means mounted on said body for securing said body to the well casing;

actuating means for expanding said sealing means and gripping means into contact with the well casing, including a first piston slidable in response to fluid pressure within a first cylinder and having first port means for conveying fluid pressure to said cylinder;

a catch on an upper portion of said packer body extending from an internal surface thereof;

setting tool means for releasably coupling said body to a tubing string and for conveying fluid pressure in the tubing string to said first port means to operate said actuating means, said setting tool means including an inner sleeve and an outer sleeve attached by coupling means for permitting limited relative axial movement between said inner and outer sleeves and having second port means for providing fluid communication between the interior of said sleeves and said first cylinder;

releasable latch means on said setting tool movable between a locking position engaging said catch and a release position disengaged from said catch, said latch means including latch members biased toward said release position and a reciprocating sleeve for maintaining said latch members in said locking position, said reciprocating sleeve being actuated by a piston and cylinder means and setting tool release means in said setting tool for conveying fluid pressure from a space between said setting tool means and the well casing and above said first sealing means to said piston and cylinder means; and second seal means on said setting tool means for providing a fluid tight seal between said setting tool means and said body bore.

7. The hydraulic packer assembly of claim 6 wherein said second port means comprises aligned ports in said inner and outer sleeves.

8. A hydraulic packer assembly for a well casing, which comprises:

a packer body having an internal axial bore extending therethrough;

first sealing means mounted on said body for forming a fluid tight seal between said body and a well casing;

gripping means mounted on said body for securing said body to the well casing;

actuating means for expanding said sealing means and gripping means into contact with the well casing, including a first piston slidable in response to fluid pressure within a first cylinder and having first port means for conveying fluid pressure to said cylinder;

setting tool means for releasably coupling said body to a tubing string and for conveying fluid pressure in the tubing string to said first port means to operate said actuating means, said setting tool means including an inner sleeve and an outer sleeve attached by coupling means for permitting limited relative axial movement between said inner and outer sleeves and having second port means for providing fluid communication between the interior of said sleeves and said first cylinder, said second port means including aligned ports in said inner and outer sleeves; and second seal means on said setting tool means for providing a fluid tight seal between said setting tool means and said body bore.

9. The hydraulic packer assembly of claim 8 wherein said outer sleeve has axially spaced seals on an inner surface thereof located above said port therein, such that limited relative axial movement of said inner and outer sleeves permitted by said coupling means will locate said inner sleeve port between said axially spaced seals closing said second port means.

10. The hydraulic packer assembly of claim 9 wherein said packer body has a radially inwardly projecting shoulder, and said outer sleeve has a radially outwardly projecting detent, said detent being spaced below said shoulder when said body is initially coupled to said setting tool means, and contacting said shoulder when said packer body is released from said setting tool means and said setting tool means is raised.

11. The hydraulic packer assembly of claim 10 wherein said inner and outer sleeves are coupled by a shear screw which separates upon applying upward force on said setting tool means after said detent contacts said body shoulder.

12. The hydraulic packer assembly of claim 11 wherein said inner sleeve has a radially inwardly extending annular recess located below said detent when said inner and outer sleeves are coupled by said shear screw, said annular recess receiving said detent to couple said inner and outer sleeves for simultaneous movement such that said second port means is closed by location of said inner sleeve port between said axially spaced seals.

13. A hydraulic packer assembly for a well casing, which comprises:

a packer body having an internal axial bore extending therethrough;

first sealing means mounted on said body for forming a fluid tight seal between said body and a well casing;

gripping means mounted on said body for securing said body to the well casing;

actuating means for expanding said sealing means and gripping means into contact with the well casing, including a first piston slidable in response to fluid pressure within a first cylinder and having first port means for conveying fluid pressure to said cylinder; and setting tool means for releasably coupling said body to a tubing string, said setting tool means including an inner sleeve and an outer sleeve attached by coupling means for permitting limited relative axial movement between said inner and outer sleeves and having second port means for providing fluid communication between the interior of said sleeves and said first cylinder controlled by said coupling means, said second port means including aligned ports in said inner and outer sleeves.

14. The hydraulic packer assembly of claim 13 wherein said outer sleeve has axially spaced seals on an inner surface thereof located above said port therein, such that limited relative axial movement of said inner and outer sleeves permitted by said coupling means will locate said inner sleeve port between said axially spaced seals closing said second port means.

15. The hydraulic packer assembly of claim 14 wherein said packer body has a radially inwardly projecting shoulder, and said outer sleeve has a radially outwardly projecting detent, said detent being spaced below said shoulder when said body is initially coupled to said setting tool means, and contacting said shoulder when said packer body is released from said setting tool means and said setting tool means is raised.

16. The hydraulic packer assembly of claim 15 wherein said inner and outer sleeves are coupled by a shear screw which separates upon applying upward force on said setting tool means after said detent contacts said body shoulder.

17. The hydraulic packer assembly of claim 16 wherein said inner sleeve has a radially inwardly extending annular recess located below said detent when said inner and outer sleeves are coupled by said shear screw, said annular recess receiving said detent to couple said inner and outer sleeves for simultaneous movement such that said second port means is closed by location of said inner sleeve port between said axially spaced seals.

18. The hydraulic packer assembly of claim 12 wherein said outer sleeve has seal means on an outer surface thereof for providing a fluid tight seal between said setting tool means and said packer body bore.

* * * * *